US006536074B2

(12) United States Patent
Boles et al.

(10) Patent No.: US 6,536,074 B2
(45) Date of Patent: Mar. 25, 2003

(54) CONVERSION VALVE ASSEMBLY

(75) Inventors: David J. Boles, Barberton, OH (US); Nick M. Bosyj, North Canton, OH (US); Jeffery S. Louis, Green, OH (US); Gregg A. McAllise, North Canton, OH (US); William McGill, Jr., Canton, OH (US); Dave O'Neal, Louisville, OH (US)

(73) Assignee: The Hoover Company, North Canton, OH (US)

( * ) Notice: Subject to any disclaimer, the term of this patent is extended or adjusted under 35 U.S.C. 154(b) by 0 days.

(21) Appl. No.: 09/851,769

(22) Filed: May 9, 2001

(65) Prior Publication Data

US 2002/0166196 A1 Nov. 14, 2002

(51) Int. Cl.[7] ..... A47L 5/32
(52) U.S. Cl. ..... 15/331; 15/334
(58) Field of Search ..... 15/331, 334, 333

(56) References Cited

U.S. PATENT DOCUMENTS 5,243,734 A 9/1993 Maurer et al.
5,351,361 A 10/1994 Buchtel
5,551,120 A * 9/1996 Cipolla et al. ..... 15/333
5,560,074 A * 10/1996 Graham et al. ..... 15/323
5,732,439 A * 3/1998 Cipolla ..... 15/334
6,209,168 B1 * 4/2001 Brickner et al. ..... 15/332

OTHER PUBLICATIONS

Photograph of Conversion Valve Assembly for Hoover Model U5755—Introduced Jun. 2000.

* cited by examiner

*Primary Examiner*—Chris K. Moore
(74) *Attorney, Agent, or Firm*—A. Burgess Lowe; Michael J. Corrigan

(57) ABSTRACT

A conversion valve arrangement for converting a vacuum cleaner from floor use to off-the-floor use. A valve door located in the suction duct leading from the nozzle body shuts off the suction airstream to the nozzle body when the vacuum cleaner is moved into the upright stored position. A projection on the motor housing located beneath the handle engages a resilient member cooperating with a crank arm on the valve door to close the valve door when the handle is moved to the upright position. The resilient member is comprised of a front valve arm and a rear valve arm pivotally linked together. The motion of the rear valve arm is transmitted to the front valve arm in one direction by a stop. The motion of the rear valve arm is transmitted to the front valve arm in the opposite direction by the stiffness of a spring disposed between them. The resiliency of the spring will allow the rear valve arm to rotate relative to the front valve arm should the valve door become stuck in the open position when the handle is moved to the upright position to prevent damage to the projection on the motor housing, the rear valve arm, front valve arm, torsional coil spring, and valve door.

18 Claims, 5 Drawing Sheets

CONVERSION VALVE ASSEMBLY

FIELD OF THE INVENTION

Generally, the invention relates to vacuum cleaners. Particularly, the invention relates to an improved conversion valve assembly design for a floor care appliance such as a vacuum cleaner.

BACKGROUND OF THE INVENTION

The use of conversion valve arrangements in upright vacuum cleaners is old and well known in the art. Automatic cleaner conversion is also known to be occasioned by movement of the cleaner handle to an upright stored position, with this movement driving the conversion valve to a converted hose operating position. An example of such an arrangement can be found in U.S. Pat. No. 5,351,361 issued to Buchtel and owned by a common assignee. However, no provision is made in such a conversion valve arrangement for the contingency of an object getting stuck in the suction duct and preventing the valve door from closing. In such a case, the large torque produced by pushing the elongated vacuum cleaner handle into the upright position can break and/or damage the linkages of the conversion valve assembly which are generally driven by the movement of the upright housing and cleaner handle.

Accordingly, it is an object of the invention to provide an upright cleaner having an improved conversion valve assembly operated by the movement of the cleaner handle.

A further object of the invention is to provide an improved conversion valve assembly wherein the linkages driving the conversion valve will not be damaged or broken by moving the cleaner handle into the upright position when the conversion valve door is stuck in the open position.

These and other objectives will be readily apparent from the following description taken in conjunction with the accompanying drawings.

SUMMARY OF THE INVENTION

In carrying out the invention in one aspect thereof, these objectives and advantages are obtained by providing an upright vacuum cleaner having a conversion valve for converting the cleaner from floor use to off-the-floor use. A conversion valve assembly is provided which automatically closes a conversion valve to shut off the suction provided to the agitator chamber when the cleaner handle and upright housing are moved to the upright position. A projection on the front of the upright housing cooperates with a rear valve arm to drive and hold the conversion valve in the shut position when the cleaner handle and upright housing are moved into the upright stored position. The suction from a suction motor is shut off to the agitator chamber and all suction is directed to the off-the-floor accessory hose. The conversion valve remains in the closed position until the cleaner handle and upright housing are released from the upright position. The projection on the front of the upright housing releases the rear valve arm freeing the valve arm to rotate freely about a pivot. The suction from the suction motor or a spring member causes the conversion valve to move into the open position. In an alternate embodiment of the invention, a spring member causes the conversion valve to move into the open position.

The conversion valve has a crank arm connected to a front valve arm for moving the conversion valve to the closed position when the cleaner handle and upright housing are moved to the upright stored position. The front valve arm cooperates with the rear valve arm when the projection on the front of the housing engages the rear valve arm when the cleaner handle and upright housing are moved into the upright stored position. The front valve arm and rear valve arm are pivotally connected and cooperate with each other via a torsion spring. The torsion spring transmits the mechanical movement created by the projection on the front of the upright housing when the upright housing and cleaner handle are moved into the upright position to the front valve arm, and the crank arm of the conversion valve to move the conversion valve into the closed position. However, should a stuck object prevent the conversion valve from closing, damage to the conversion valve, crank arm, front valve arm, rear valve arm, and front projection is prevented because the resiliency of the torsion spring allows the rear crank arm and the front crank arm to pivot relative to each other when the projection depresses the rear crank arm when the upright housing and cleaner housing are moved into the upright stored position.

BRIEF DESCRIPTION OF DRAWINGS

Embodiments of the invention, illustrative of several modes in which applicants have contemplated applying the principles are set forth by way of example in the following description and are shown in the drawings and are particularly and distinctly pointed out and set forth in the appended claims.

DESCRIPTION OF THE PREFERRED EMBODIMENT

Figure 1:
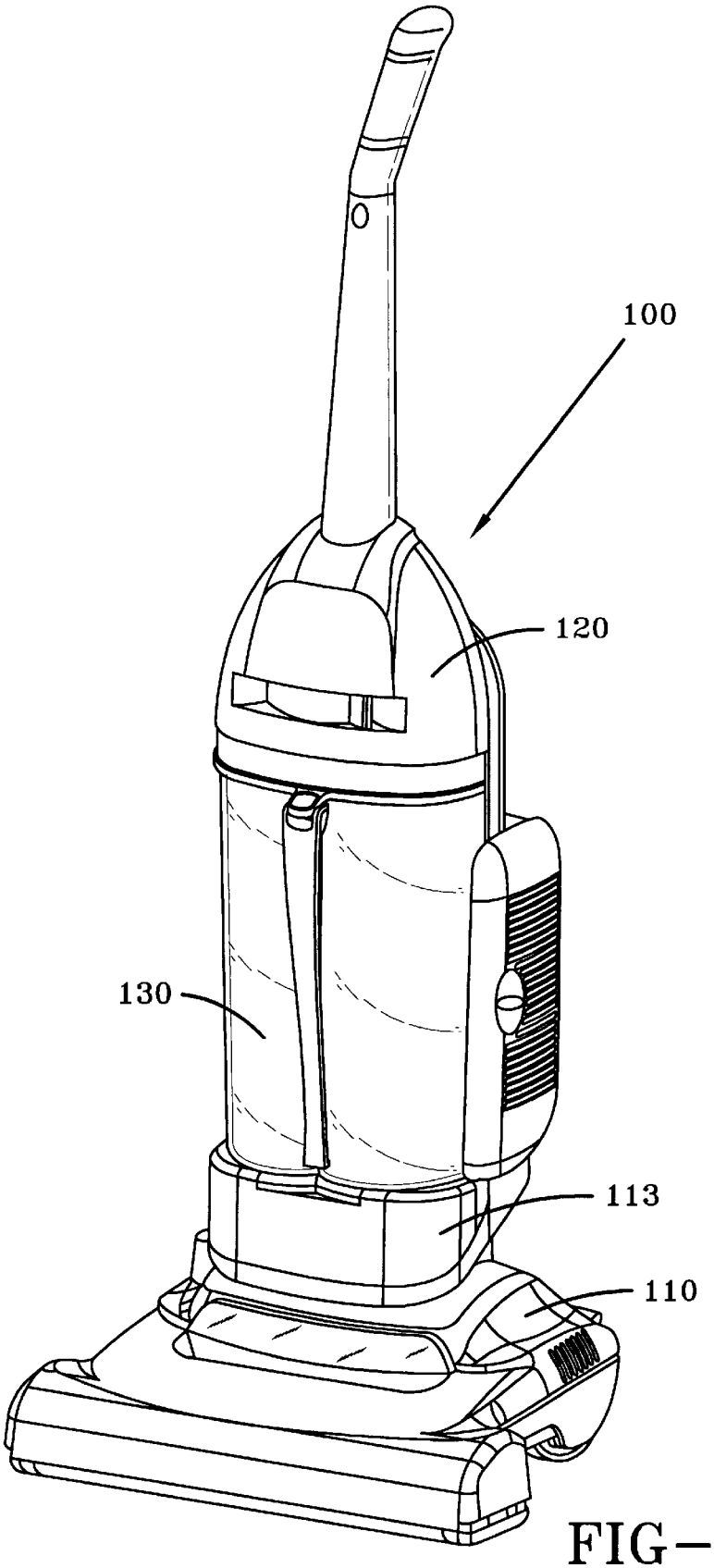
FIG. 1 is a perspective view of a vacuum cleaner which includes the present invention.
Figure 4:
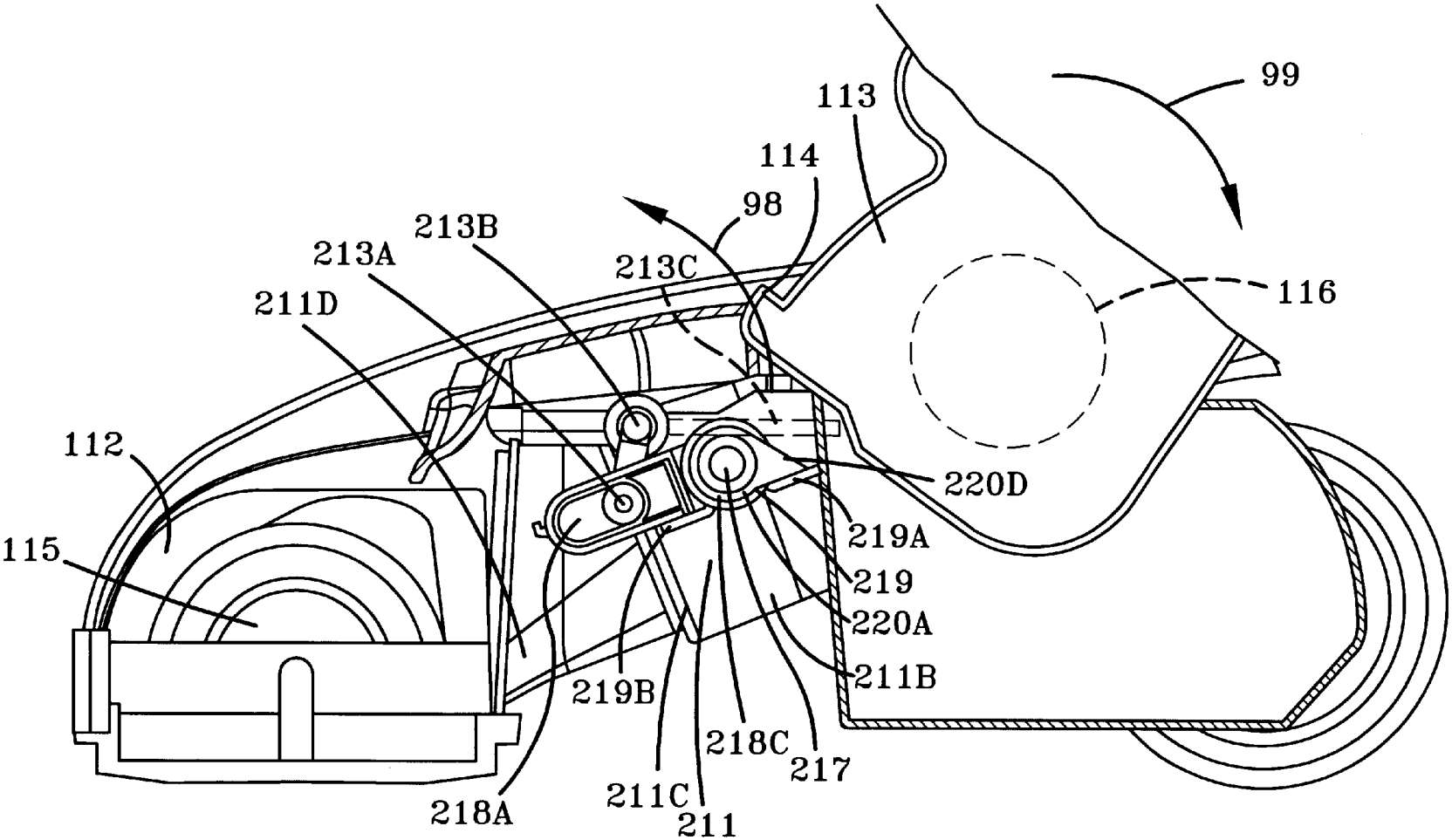
FIG. 4 is a side view of the vacuum cleaner of FIG. 1 taken along line II—II of FIG. 2.
Figure 5:
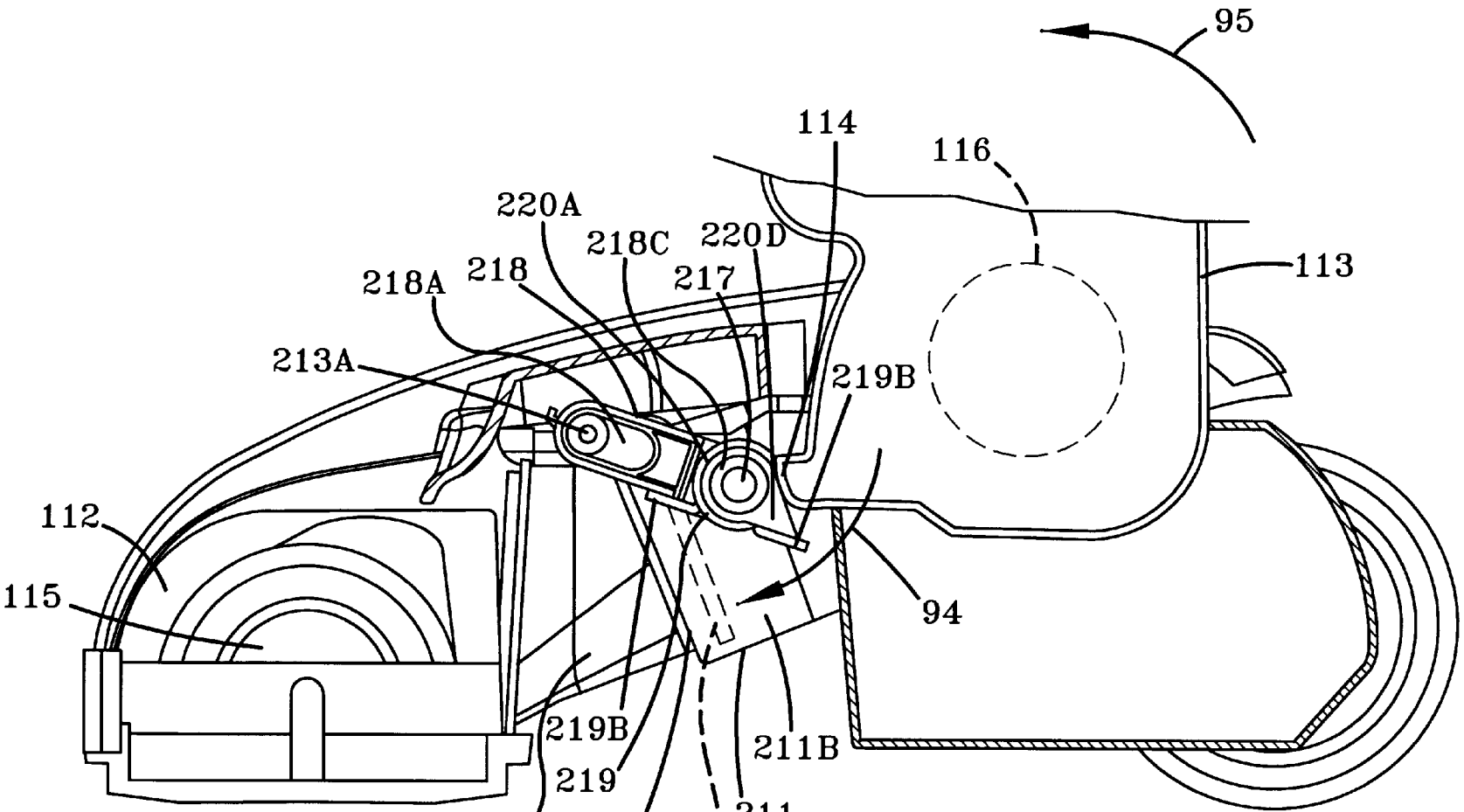
FIG. 5 is a side view of the vacuum cleaner of FIG. 1 taken along line II—II of FIG. 2.

A vacuum cleaner incorporating the present is shown in FIG. 1 and is indicated generally at 100. Vacuum cleaner 100 includes a vacuum cleaner foot 110 and a vacuum cleaner housing 120 connected to the vacuum cleaner foot 110. The foot 110 is formed with a bottom nozzle opening (not shown) which opens towards a floor surface. In the preferred embodiment, the vacuum cleaner is similar to the indirect air bagless vacuum cleaner disclosed in U.S. patent application Ser. No. 09/519,106 owned by a common assignee which is incorporated by reference fully herein. In an alternate embodiment of the invention, the vacuum cleaner may be a direct air vacuum cleaner or any other type of floor care appliance utilizing suction and being capable of being converted from floor use to off-the-floor use. The vacuum cleaner 100 is of the type having an agitator 114 (FIGS. 4 and 5) positioned within an agitator chamber 112 (FIGS. 4 and 5) formed in an agitator housing 210 (FIG. 2) which is part of foot 110. Agitator chamber 112 communicates with the nozzle opening (not shown) and agitator 114 rotates about a horizontal axis inside agitator chamber 112 for loosening dirt from the floor surface. The loosened dirt is drawn into a conversion valve duct 211 located behind and fluidly connected to agitator chamber 112 by a suction airstream generated by a motor-fan assembly 116 (FIGS. 4 and 5).

Figure 2:
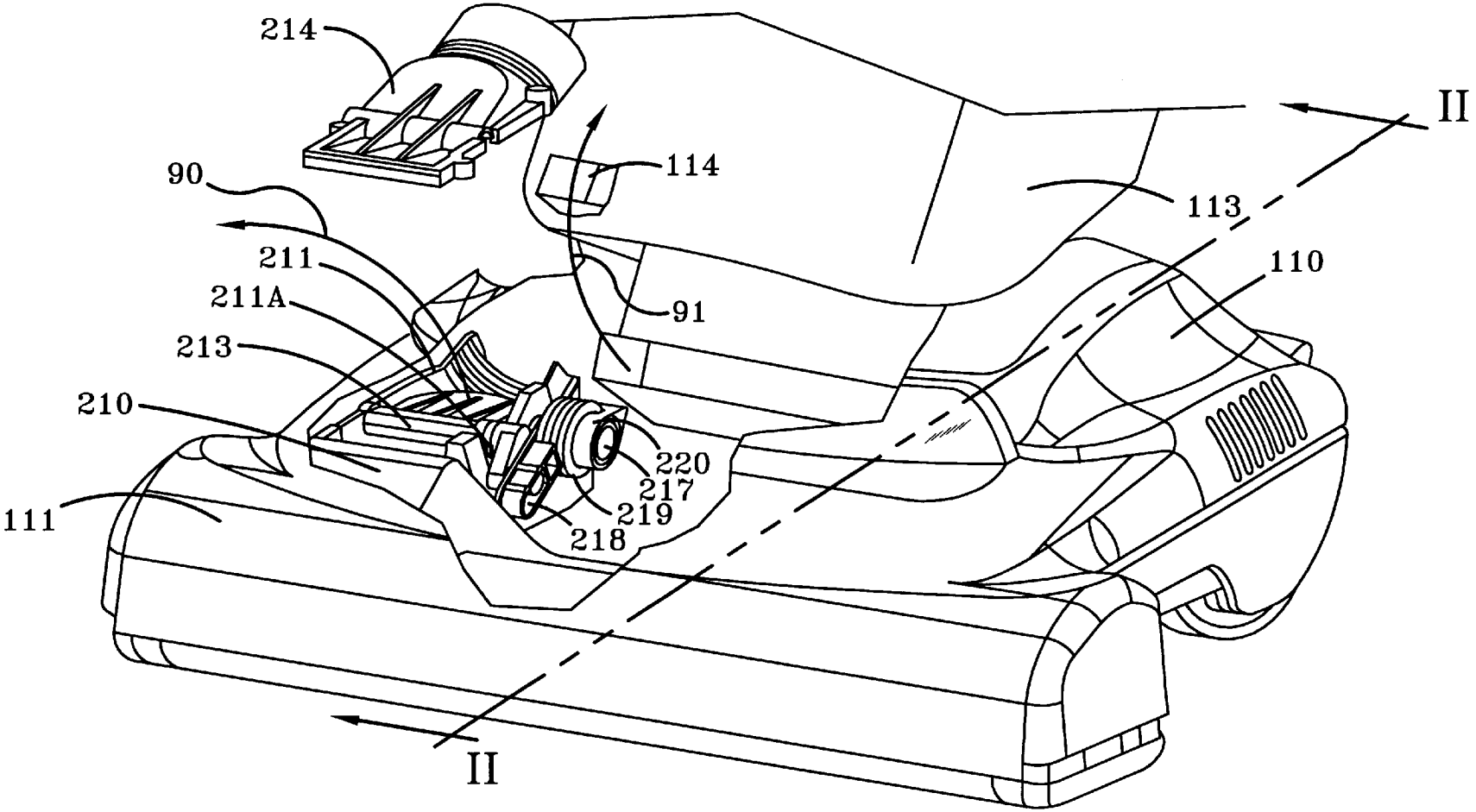
FIG. 2 is the vacuum cleaner of FIG. 1 with a partial cutaway portion showing the conversion valve assembly.
Figure 3:
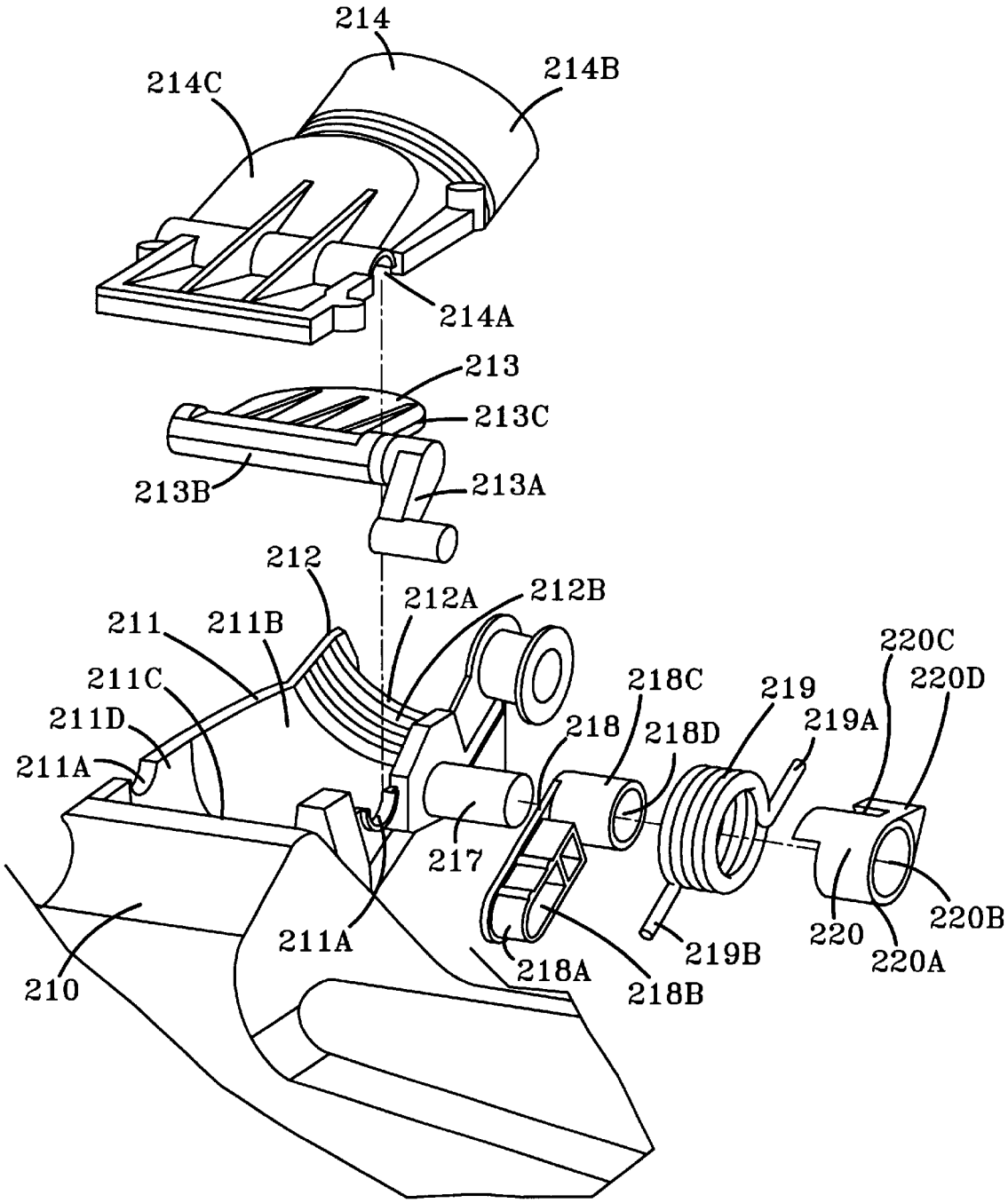
FIG. 3 is a exploded view of the cutaway portion of vacuum cleaner of FIG. 2 showing the conversion valve assembly.

Referring now to FIGS. 2 and 3, conversion valve duct 211 is fluidly connected to motor-fan assembly 116 (FIGS. 4 and 5) by a suction hose (not shown) or other means. In the preferred embodiment, conversion valve duct 211 has a first portion of a suction hose connector 212 extending rearwardly for receiving the suction hose (not shown). A plurality of annular ribs 212*b* are formed on the inner surface of the first portion of suction hose connector 212 for gripping the complementary ribs on the lower portion of one end of a suction hose (not shown). The connection of the suction hose (not shown) to conversion valve duct 211 will be described further hereinbelow.

Located inside conversion valve duct 211 is a conversion valve 213 for selectively fluidly disconnecting the suction airstream from the agitator chamber 112. There are instances where it is desirable to fluidly disconnect the suction airstream from the agitator chamber 112. For example, many vacuum cleaners are equipped with an accessory suction hose (not shown) fluidly connected to the motor-fan assembly (FIGS. 4 and 5) at some other point for off-the-floor cleaning of upholstery, drapes, and the like. In this case, it is desirable to have the maximum amount of suction from the motor-fan assembly 116 available to the suction inlet of the accessory hose (not shown). This requires diverting the suction airstream directed to the agitator chamber 112 to the accessory hose (not shown). Some cleaners actually have the suction airstream directed to both the agitator chamber 112 and the accessory hose (not shown) at all times but the suction outlet (not shown) off the accessory hose (not shown) is sealed by placing the suction inlet onto a projection on the accessory hose holder (not shown) while in the storage position. Thus, the suction inlet (not shown) is sealed and the maximum amount of suction from the motor-fan assembly 116 (FIGS. 4 and 5) is directed to the agitator chamber 112. Conversely, when the accessory hose (not shown) is removed from the accessory hose holder (not shown), the suction inlet (not shown) of the accessory hose (not shown) is unrestricted but only a portion of the total suction produced by the motor-fan assembly 116 is available since a portion of the suction is still directed to the agitator chamber 112. It is desirable then to fluidly disconnect the agitator chamber 112 from the motor-fan assembly 116 so the maximum amount of suction is directed to the suction inlet (not shown) of the accessory hose (not shown). This is accomplished by a conversion valve 213 which selectively shuts of the suction airstream to the agitator chamber 112 by blocking the conversion valve duct 211.

Conversion valve 213 selectively shuts of the suction airstream to the agitator chamber 112 by being moved from an open position (FIG. 4) to a closed position (FIG. 5) by the movement of the housing 120 (FIG. 1) into an upright stored position. It is desirable to move housing 120 (FIG. 1) into an upright stored position when it is desired to use the accessory hose (not shown) for off-the-floor cleaning. A special projection 114 located on the front of motor housing 113 depresses a rear valve arm 220 when housing 120 (FIG. 1) is moved to the upright stored position. The rear valve 220 cooperates with a front valve arm 218 via a torsional spring 219 which transmits the motion of rear valve arm 220 to front valve arm 218. Front valve arm 218 cooperates with the crank arm 213*a* of conversion valve 213 move conversion valve into the closed position.

Referring now specifically to FIG. 3, a conversion valve 213 is installed in conversion valve duct 211 by being inserted into a conversion valve cavity 211 a located therein and is rotatably held therein by a conversion valve duct cover 214. Conversion valve 213 has a valve door portion 213*c*, a spindle portion 213*b*, and a crank arm 213*a* extending sidewardly from the spindle portion 213*b*. The spindle portion 213*b* of conversion valve 213 on opposing lateral sides of valve door 213*c* is received by a pair of opposing recesses 211*a* formed in the opposing sidewalls of conversion valve duct 211. A semi-circular shaped channel 214*a* is formed in the upper surface of conversion valve duct cover 214 for receiving the spindle portion 213*b* of conversion valve 213 when conversion valve duct cover 214 is installed on top of conversion valve duct 211. Thus, the spindle portion 213*b* of conversion valve 213 is free to rotate as well as conversion valve door 213 connected thereto inside conversion valve duct cavity 211*b*. Conversion valve duct cover 214 also includes a recessed portion 214*c* for receiving conversion valve door 213 when in the open position. A lip 211 (also seen in FIGS. 4 and 5) is formed in the inner surface of conversion valve suction duct 211, separating conversion valve suction duct 211 into the aforesaid conversion valve cavity 211*a* and a conversion valve suction duct forward portion 211*d*. Lip 211 acts as a stop for conversion valve 213 as it is rotated into the closed position and acts as a seat for conversion valve 213 preventing conversion valve 213 from being rotated into conversion valve suction duct forward portion 211*d*. Conversion valve duct cover 214 is installed on top of conversion valve duct 211 using screws, adhesives or other fastening means. Conversion valve duct cover 214 also has a conversion valve duct cover hose connector portion 214*b* extending rearwardly therefrom with ribs located on the inner surface thereon (not shown) for gripping the upper portion of the end of the suction hose (not shown) when conversion valve suction duct cover 214 is in the installed position.

Turning back to the detail of the cooperation of rear valve arm 220 and front valve arm 218 with conversion valve 213, and referring now to FIGS. 3–5, front valve arm 218 is installed on a pivot 217 extending from the inner sidewall of conversion valve suction duct 211. Front valve arm 218 has a cylindrical portion 218*c* with a hollow interior 218*d* which fits over pivot 217 and a lever portion 218*a* extending from cylindrical portion 218*c* in a cantilever fashion. A slotted aperture 218*b* is formed in lever portion 218*a* which slidingly receives crank arm 213*a*. Rear valve arm 220 is generally cylindrical in shape having a cylindrical portion 220*a* with a hollow interior 220*b*, a sidewardly extending projection 220*d* with a flat upper surface, and a notch 220*c* formed between projection 220*d* and cylindrical portion 220*a*. A torsional coil spring 219 with a hollow center and a first free end 219*a* and a second free end 219*b* fits over cylindrical portion 220*a* with notch 220 receiving and holding fast first free end 219*a* of torsional coil spring 219. The hollow interior 220*b* of the cylindrical portion 220*a* of rear valve arm 220 fits over the outer periphery of the perimeter of the cylindrical portion 218*c* of front valve arm 218. The second free end of torsional coil spring 219*b* is received underneath the lever portion 218*a* of front valve arm 218. Thus, rear valve arm 220 is capable of rotating relative to front arm 218 in the clockwise direction but being prevented from doing so by the stiffness of torsional coil spring 219. A rear valve arm stop 220*e* extends sidewardly from cylindrical portion 220*a* of rear valve arm 220 which engages the lever portion 218*a* of front valve arm 218 to prevent rear valve arm 220 from rotating counter-clockwise relative to front valve arm 218. The purpose for rear valve arm 220 being capable of rotating relative to front valve arm 218 in one direction, but prevented from doing so by torsional spring 219, but incapable in the opposite direction, is explained in the following paragraphs.

Referring now specifically to FIGS. 4 and 5, the operation of conversion valve 213 from the open position (FIG. 4) to the closed position (FIG. 5) is demonstrated. As housing 120 (FIG. 1) and motor housing 113 located on the bottom thereof are rotated in the direction of arrow 99 to the floor use position, projection 114 on the front of motor housing 113 is lifted from the flat upper surface of projection 220*d* of rear valve arm 220. Rear valve arm 220 and front valve arm 218 are now free to rotate relative to pivot 217 being prevented from rotating relative to each other by torsional coil spring 219 in the clockwise direction and by rear valve arm stop 220*e* in the counter-clockwise direction. The suction airstream formerly prevented from entering agitator chamber 112 by conversion valve 213 being in the closed position causes conversion valve 213 to rotate in the direction of arrow 99 until valve gate 213*c* is rotated into recessed portion 214*c* of conversion valve suction duct cover 214. In an alternate embodiment of the invention, a spring member (notshown) causes conversion valve 213 to rotate in the direction of arrow 99 until valve gate 213*c* is rotated into recessed portion 214*c* of conversion valve suction duct cover 214. The suction airstream is now free again to flow from agitator chamber 112 through conversion valve suction duct forward portion 211*d* and conversion valve cavity 211 a to the connecting hose (not shown) from motor-fan assembly 116. When housing 120 (FIG. 1) and motor housing 113 are returned to the upright stored position by being rotated in the direction of arrow 95, typically when it is desired to use the accessory hose (not shown) for off-the-floor cleaning, projection 114 on the front of motor housing 114 depresses the flat upper surface of projection 220*d* of rear valve arm 220. Rear valve arm 220 now rotates in the direction of arrow 94 and the motion of rear valve arm 220 is transmitted to front valve arm 218 by torsional coil spring 219. This causes front valve arm 218 to rotate about pivot 217 also in the direction of arrow 94. The rotation of front valve arm in the direction of arrow 94 causes crank arm 213*a* slidingly fitted into aperture 218*b* of front valve arm 218 to translate towards the rear of the cleaner and valve door 213*c* to rotate in the direction of arrow 94 until valve door 213*c* is seated against lip 211*c*.

Moreover, if valve door 213*c* is prevented from rotating in the direction of arrow 94, i.e, an object becomes stuck between valve door 213*c* and the upper surface of conversion valve suction duct 211, the large torque created by moving housing 120 (FIG. 1) and motor housing 113 into the upright stored position can put enough force on rear valve arm 220 to overcome the resiliency of torsional coil spring 219 to allow rear valve arm 220 to rotate relative to front valve arm 218. Normally the movement of housing 120 (FIG. 1) and motor housing 113 into the upright stored position would cause projection 114 on the front of motor housing to engage the upper flat surface of projection 220*d* of rear valve arm 220 causing front valve arm 218 and crank arm 213*a* to translate to rotate valve door 213*c* closed. Since valve door 213*c* is stuck, crank arm 213*a* cannot translate in either direction and front valve arm 218 is prevented from rotating. The force of housing 120 (FIG. 1) and motor housing 113 when rotated in the direction of arrow 95 through projection 114 to rear valve arm 220 could damage or break one or more components of the conversion valve assembly, including projection 114, rear valve arm 220, front valve arm 220, pivot 117, crank arm 213*a*, spindle 213*b* or valve door 213*c*. The resiliency of torsional coil spring 219 allows rear valve arm 220 to rotate in the direction of arrow 94 relative to front valve arm 218 when housing 120 and motor housing 113 are moved to the upright stored position even though front valve arm 218 is prevented from rotating because valve door 213*c* is stuck in the open position.

Accordingly, the improved valve conversion assembly for a vacuum cleaner is simplified, provides an effective, inexpensive, and efficient device which achieves all of the enumerated objectives. While there has been shown and described herein a single embodiment of the present invention, it should be readily apparent to persons skilled in the art that numerous modifications may be made therein without departing from the true spirit and scope of the invention. Accordingly, it is intended by the appended claims to cover all modifications which come within the spirit and scope of the invention.

What is claimed is:

1. A conversion valve arrangement for use with a vacuum cleaner having a handle pivotally attached to a main nozzle body and motor-fan assembly for creating a suction airstream, comprising:

a valve door in a suction duct leading to the main nozzle body, said valve door movable between open and closed positions;

a resilient member cooperating with said valve door for moving said valve door to at least one of its position;

a projection mounted on the handle cooperating with said resilient member for moving said valve into the closed position when said handle is moved into an upright position; and wherein said resilient member prevents damage to said resilient member, said valve door, and said projection if said valve door is stuck in the closed position and said valve door is moved to the open position by the suction airstream.

2. The conversion valve arrangement of claim 1, wherein said valve door is moved to the open position by a spring member.

3. The conversion valve arrangement of claim 1, wherein said resilient member includes a rear valve arm pivotally linked to a front valve arm and a spring.

4. The conversion valve arrangement of claim 3, wherein said rear valve arm is capable of rotating relative to said front valve in the clockwise direction but prevented from doing so by the stiffness of said spring.

5. The conversion valve arrangement of claim 3 wherein said rear valve arm is prevented from rotating relative to said front valve in the counter-clockwise direction by a rear valve arm stop which engages a lever portion of said front valve arm.

6. The conversion valve arrangement of claim 5 wherein said valve door includes a crank arm cooperating with said lever portion of said front valve arm.

7. The conversion valve arrangement if claim 6 wherein the movement of said rear valve arm is transmitted to said valve door by said front valve arm and said crank arm.

8. The conversion valve arrangement of claimed 3 wherein said projection engages said rear valve arm when said handle is moved into the upright position and the resiliency of said spring allows said rear valve arm to rotate relative to said front valve arm in the clockwise direction when said valve door is stuck in the open position when said handle is moved into the upright position.

9. The conversion valve arrangement of claim 3 wherein said spring is a torsional coil spring.

10. In an upright vacuum cleaner having a handle pivotally attached to a main nozzle body and motor-fan assembly for creating a suction airstream, the improvement comprising:

a valve door in a suction duct leading to the main nozzle body, said valve door movable between open and closed positions;

a resilient member cooperating with said valve door for moving said valve door to at least one of its position;

a projection mounted on the handle cooperating with said resilient member for moving said valve into the closed position when said handle is moved into an upright position; and wherein said resilient member prevents damage to said resilient member, said valve door, and said projection if said valve door is stuck in the closed position and said valve door is moved to the open position by the suction airstream.

11. The conversion valve arrangement of claim 10, wherein said valve door is moved to the open position by a spring member.

12. The conversion valve arrangement of claim 10, wherein said resilient member includes a rear valve arm pivotally linked to a front valve arm and a spring.

13. The conversion valve arrangement of claim 12, wherein said rear valve arm is capable of rotating relative to said front valve in the clockwise direction but prevented from doing so by the stiffness of said spring.

14. The conversion valve arrangement of claim 12 wherein said rear valve arm is prevented from rotating relative to said front valve in the counter-clockwise direction by a rear valve arm stop which engages a lever portion of said front valve arm.

15. The conversion valve arrangement of claim 12 wherein said projection engages said rear valve arm when said handle is moved into the upright position and the resiliency of said spring allows said rear valve arm to rotate relative to said front valve arm in the clockwise direction when said valve door is stuck in the open position when said handle is moved into the upright position.

16. The conversion valve arrangement of claim 12 wherein said spring is a torsional coil spring.

17. The conversion valve arrangement of claim 10 wherein said valve door includes a crank arm cooperating with said lever portion of said front valve arm.

18. The conversion valve arrangement if claim 17 wherein the movement of said rear valve arm is transmitted to said valve door by said front valve arm and said crank arm.

* * * * *